US010775745B2

(12) United States Patent
Gilomen et al.

(10) Patent No.: US 10,775,745 B2
(45) Date of Patent: Sep. 15, 2020

(54) TIMEPIECE COMPRISING A DAY/NIGHT DISPLAY THAT TAKES ACCOUNT OF SEASONAL VARIATIONS

(71) Applicant: The Swatch Group Research and Development Ltd, Marin (CH)

(72) Inventors: Beat Gilomen, Grenchen (CH); Dominique Lechot, Les Reussilles (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/835,518

(22) Filed: Dec. 8, 2017

(65) Prior Publication Data

US 2018/0181069 A1 Jun. 28, 2018

(30) Foreign Application Priority Data

Dec. 23, 2016 (EP) ..... 16206811

(51) Int. Cl.
*G04B 19/26* (2006.01)
*G04B 19/253* (2006.01)
*G04B 19/22* (2006.01)

(52) U.S. Cl.
CPC ..... *G04B 19/262* (2013.01); *G04B 19/226* (2013.01); *G04B 19/25366* (2013.01)

(58) Field of Classification Search
CPC ..... G04B 19/226; G04B 19/26; G04B 19/262
See application file for complete search history.

(56) References Cited

U.S. PATENT DOCUMENTS 1,997,511 A * 4/1935 Canepa ..... G04B 19/268 368/18
2,023,677 A 12/1935 Fowler
3,305,946 A 2/1967 du Gardin
4,102,121 A 7/1978 Veazey
5,132,943 A * 7/1992 Davies ..... G04B 19/226 368/21
5,383,165 A * 1/1995 Vaucher ..... G04B 19/25 368/185
7,012,855 B1 3/2006 Loaiza
(Continued)

FOREIGN PATENT DOCUMENTS

EP 3 007 012 A1 4/2016

OTHER PUBLICATIONS

European Search Report dated Aug. 23, 2017 in European Application 16206811.8 filed on Dec. 23, 2016 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

A timepiece movement, a calendar mechanism and device for indicating the sunrise and sunset that takes account of seasonal variations. The simple calendar mechanism includes a display mechanism for displaying the date and a display mechanism for displaying the month. The sunrise and sunset indicating device also includes an annual cam having a profile representative of the tilt of the sun with respect to the equatorial plane and arranged to be driven in rotation via the hour wheel set through a kinematic chain that passes through the month display device and has a transmission ratio of 1:744.

15 Claims, 6 Drawing Sheets

(56) References Cited

U.S. PATENT DOCUMENTS

| | | | | |
|---|---|---|---|---|
| 2002/0131329 | A1* | 9/2002 | Ochoa Loaiza | G04B 19/226<br>368/23 |
| 2012/0243381 | A1* | 9/2012 | Goeller | G04B 19/25<br>368/34 |
| 2012/0243388 | A1* | 9/2012 | Goeller | G04B 13/003<br>368/169 |
| 2014/0126336 | A1* | 5/2014 | Goeller | G04B 19/268<br>368/15 |
| 2015/0234357 | A1* | 8/2015 | Willemin | G04B 19/262<br>368/17 |
| 2016/0098012 | A1* | 4/2016 | Gilomen | G04B 19/26<br>368/17 |

* cited by examiner

TIMEPIECE COMPRISING A DAY/NIGHT DISPLAY THAT TAKES ACCOUNT OF SEASONAL VARIATIONS

This application claims priority from European Patent Application No. 16206811.8 filed on Dec. 23, 2016, the entire disclosure of which is hereby incorporated herein by reference.

FIELD OF THE INVENTION

The present invention concerns a timepiece comprising a timepiece movement, a calendar mechanism and means for indicating the sunrise and sunset that take account of seasonal variations, the timepiece movement comprising a minute wheel set, a motion-work, a member for indicating the hours, and an hour wheel set integral in rotation with the hour indicator member and arranged to be driven by the minute wheel set via the motion-work at a speed of one revolution in 12 hours, or at a speed of one revolution in 24 hours, the calendar mechanism being arranged to be driven via the hour wheel set and comprising means for displaying the date and means for displaying the month, the sunrise and sunset indicating means comprising a sphere that replicates the terrestrial globe, a support, and a ring mounted on the support concentrically to the sphere and arranged to indicate the position of the earth's terminator, the ring and the sphere being arranged to rotate with respect to each other, at a rate of one revolution in 24 hours, about a first axis corresponding to the polar axis of the terrestrial globe, and the ring being mounted on the support in order also to be able to pivot relative to the sphere about a second axis intersecting the first axis perpendicularly at the centre of the sphere, the sunrise and sunset indicating means further comprising an annual cam having a profile representative of the tilt of the sun with respect to the equatorial plane, and arranged to be driven in rotation at the rate of one revolution per year, a cam follower arranged to cooperate with the cam, and a first kinematic chain arranged to connect the cam follower to the ring, such that the plane subtended by the ring forms with the first axis an angle equal to the angle of tilt of the sun with respect to the equatorial plane. The present invention concerns, in particular, a timepiece of this type, wherein the sunrise and sunset indicating means that take account of seasonal variations also indicate which part of the earth's surface is in daylight (day) and which part of the earth's surface is in darkness (night time).

PRIOR ART

The duration of the day is the time comprised, each day, from the moment when the upper limb of the sun appears above the horizon in the east, at sunrise, until it disappears below the horizon in the west, at sunset. Whatever the time, there is always one half of the earth's surface that is illuminated by the sun, and another half which is in darkness. The earth's terminator is the line of demarcation between the portion of the earth which is illuminated and that which is in darkness. Geometrically speaking, the earth's terminator is a large circle which encircles the earth. This large circle extends in a plane perpendicular to the plane of the earth's orbit around the sun (called the ecliptic plane). It is also noted that the centre of the earth is on the line of intersection between these two planes.

Generally, the length of day varies throughout the year and depends on latitude. This variation is caused by the tilt of the axis of rotation of the earth on itself with respect to the ecliptic plane. This tilt by definition corresponds to the latitude of the tropics which is ±23° 27'. As is well known, the length of day is shortest at the December Solstice in the Northern Hemisphere, and at the June Solstice in the Southern Hemisphere. At the equinoxes, the length of day and night are equal everywhere on earth.

There are already known timepieces arranged to indicate the current position of the boundary between day and night and which meet the definition given in the above preamble. Descriptions are found, in particular, in European Patent documents EP2911013, EP2977832 and EP3007012 in the name of the Applicant. However, the use and the design of these timepieces present a certain number of difficulties.

In particular, these timepieces comprise an annual cam which has a profile representative of the tilt of the sun with respect to the equatorial plane, and which is arranged to be driven in rotation by the movement at the rate of one revolution per year. One drawback of these timepieces is that it may be problematic to return the annual cam to the correct position after an indeterminate period of stoppage of the timepiece.

BRIEF SUMMARY OF THE INVENTION

It is an object of the present invention to overcome the aforementioned drawbacks of the prior art. The invention achieves this object by providing a timepiece movement.

According to the invention, the timepiece comprises a calendar mechanism arranged to be driven via the hour wheel set and which comprises means for displaying the date and means for displaying the month. The timepiece also comprises a third kinematic chain which connects the hour wheel set to the annual cam via the month display means. A first advantage of this feature is that, after an indeterminate period of stoppage of the timepiece, the annual cam can automatically be returned to the correct position without any possible error, simply by resetting the date of the calendar mechanism.

According to the invention, the calendar mechanism is driven by the hour wheel set. In these conditions, when the wearer of the timepiece changes the hour indication, for example to correct it, the hour correction automatically results in correction of the calendar mechanism and the annual cam.

Moreover, according to the invention, the third kinematic chain has either a transmission ratio of 1:744 (in the case where the hour wheel set is arranged to be driven by the motion work at a speed of one revolution in 12 hours), or a transmission ratio of 1:372 (in the case where the hour wheel set is arranged to be driven by the motion work at a speed of one revolution in 24 hours).

It can be confirmed that 372 is the number of days that the year would have if all the months had 31 days (and 744 corresponds to two times 372). A calendar mechanism in which all the months have 31 days is called a simple calendar mechanism. In this type of calendar mechanism, at the end of months of less than 31 days, the hand or date disc must be advanced manually to update the calendar. As regards the change of indication of the name of the month, this can occur automatically every time that the date indication changes from the 31st to the 1st day of the month. Those skilled in the art will tend to consider that if the annual cam is not driven via the date display means, the difference between the real time and the current position of the earth's terminator on the globe will gradually increase. However, if, for example, the date is advanced at the end of the months of less than 31 days using the set-hands mechanism, there is no risk of this date setting operation desynchronizing the calendar mechanism and annual cam.

According to a particular embodiment of the invention, the timepiece movement comprises a manually actuatable summer/winter correction mechanism for changing from summer time to winter time, or vice versa, by pivoting the hour wheel set one step forward or backward independently of the motion work. Those skilled in the art will understand that a first advantage of this feature is that it allows the summer time/winter time correction to be made without affecting the indication of the minutes and the indication of the seconds.

According to an advantageous variant of the aforementioned embodiment, the manually actuatable mechanism is also arranged to pivot the hour wheel set without affecting the indication of the position of the earth's terminator on the sphere. Those skilled in the art will understand that one advantage of this feature is that it prevents the position of the ring changing relative to the terrestrial globe when this does not reflect a real movement of the sun with respect to the earth's surface.

BRIEF DESCRIPTION OF THE DRAWINGS

Other features and advantages of the invention will appear upon reading the following description, given purely by way of non-limiting example, with reference to the annexed drawings, in which.

DETAILED DESCRIPTION OF EMBODIMENTS

Figure 1:
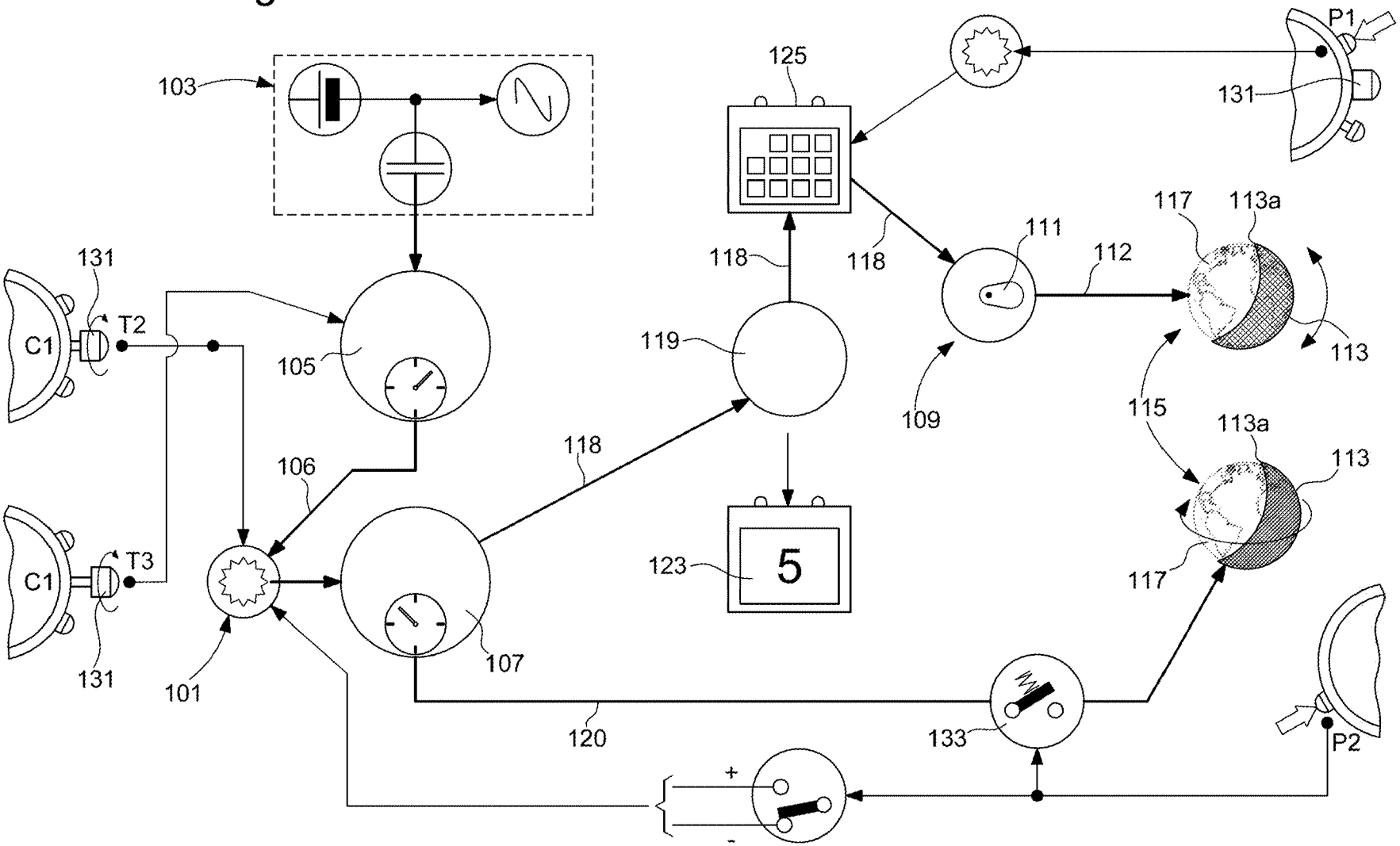
FIG. 1 is a block diagram briefly illustrating the kinematic connections between different mechanisms of a timepiece according to a first particular embodiment of the invention.

FIG. 1 annexed is a block diagram illustrating the kinematic connections associating different mechanisms of a timepiece according to a first exemplary embodiment of the invention. This extremely basic block diagram represents the means for transmitting the driving force provided by the movement to the various mechanisms with the aid of double-thickness arrows, and the kinematic connections which are arranged to transmit the commands manually inputted by a user with the aid of thinner arrows.

In the block diagram of FIG. 1, the arrows symbolising kinematic connections connect between them symbols which represent different mechanisms of the timepiece. The mechanisms represented by the symbols comprise a drive mechanism 103 that combines a drive member, a regulating member and an escapement, a minute wheel set (referenced 105) which is integral with a minute display member and which is arranged to be driven at the rate of one revolution per hour by the drive mechanism, an hour wheel set 107 integral in rotation with an hour display member, a motion work 106 connecting the minute wheel set to the hour wheel set, such that the latter is driven at the rate of one revolution every 12 hours, and a time zone correction mechanism (referenced 101) inserted between motion work 106 and hour wheel set 107.

According to the invention, the illustrated timepiece also comprises sunrise and sunset indicating means that take account of seasonal variations, these means comprising a sphere that replicates the terrestrial globe, a support, and a ring which is mounted on the support concentrically to the sphere and arranged to indicate the position of the earth's terminator. The ring and the sphere are arranged to be driven in order to rotate with respect to one another, at a rate of one revolution in 24 hours, about a first axis corresponding to the polar axis of the terrestrial globe. Further, the ring is mounted on the support in order also to be able to pivot relative to the sphere about a second axis intersecting the first axis perpendicularly at the centre of the sphere. The sunrise and sunset indicating means further comprise an annual cam having a profile representative of the tilt of the sun with respect to the equatorial plane and which is arranged to be driven in rotation at the rate of one revolution per year, a cam follower arranged to cooperate with the cam, and a first kinematic chain arranged to connect the cam follower to the ring, such that the plane subtended by the ring forms with the first axis an angle equal to the angle of tilt of the sun with respect to the equatorial plane. Referring again to FIG. 1, it can be seen that, in the embodiment represented, the timepiece comprises a sunrise and/or sunset indicating mechanism 115 which comprises a sphere 117 representing the terrestrial globe and a half-spherical shell 113, which is arranged concentrically to sphere 117 so as to darken or conceal the half of the earth's surface which is in darkness (night). Shell 113 has a substantially circular rim 113*a*, which forms the ring of the sunrise and sunset indicating means according to the invention.

Referring again to FIG. 1, it can be seen that the illustrated timepiece also comprises a calendar mechanism arranged to be driven via the hour wheel set 107. The calendar mechanism represented comprises means for displaying the date 123 and means for displaying the month 125. According to the invention, the calendar mechanism is of the 'simple calendar' type. As is well known to those skilled in the art, in a simple calendar mechanism, at the end of months of less than 31 days, the date display must be advanced manually to correct the date. As regards the change of indication of the name of the month, this occurs automatically every time that the date indication changes from the 31st to the 1st day of the month.

Figure 4A:
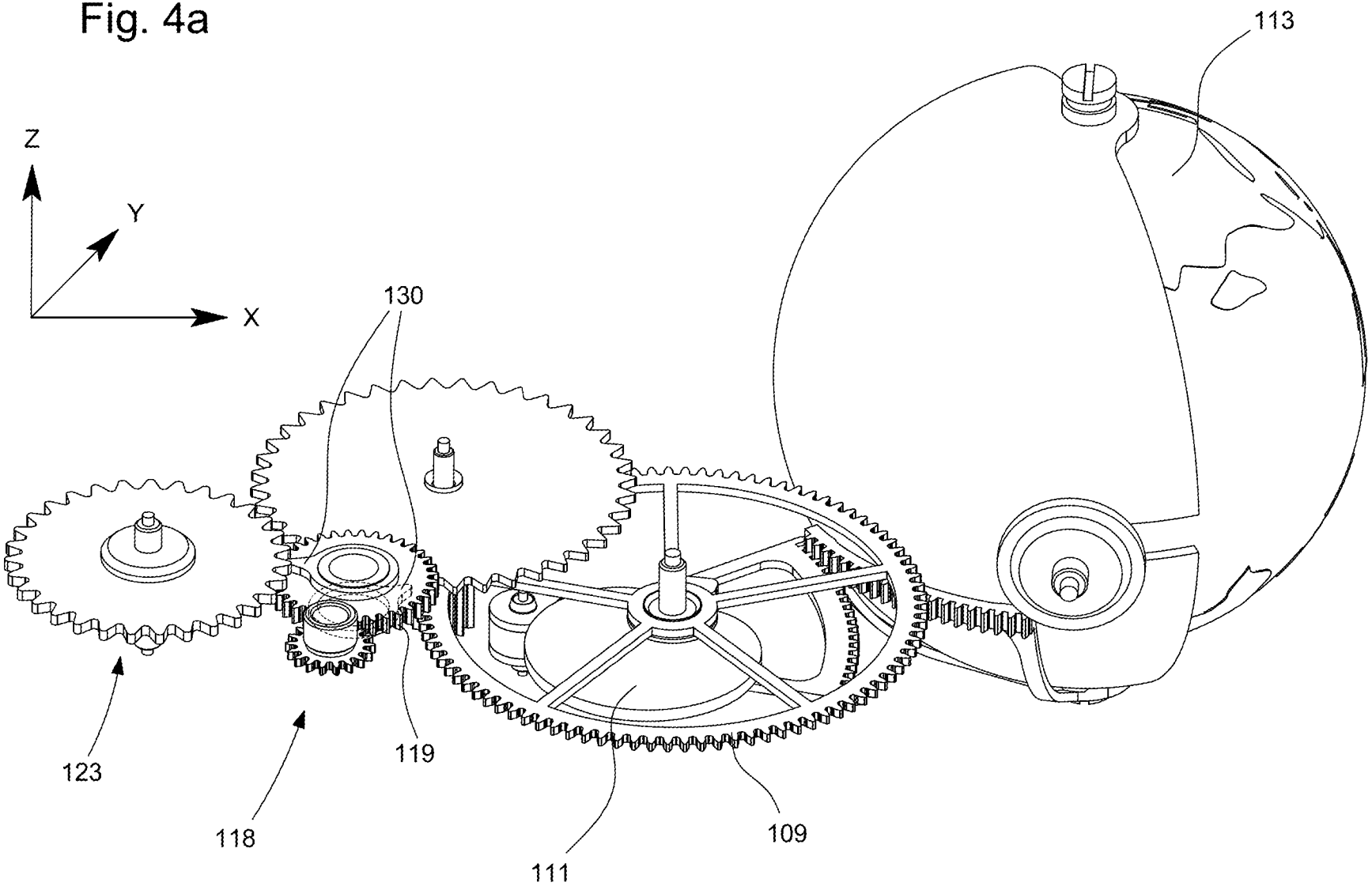
FIGS. 4*a* and 4*b* are views of structural elements of the timepiece.
Figure 4B:
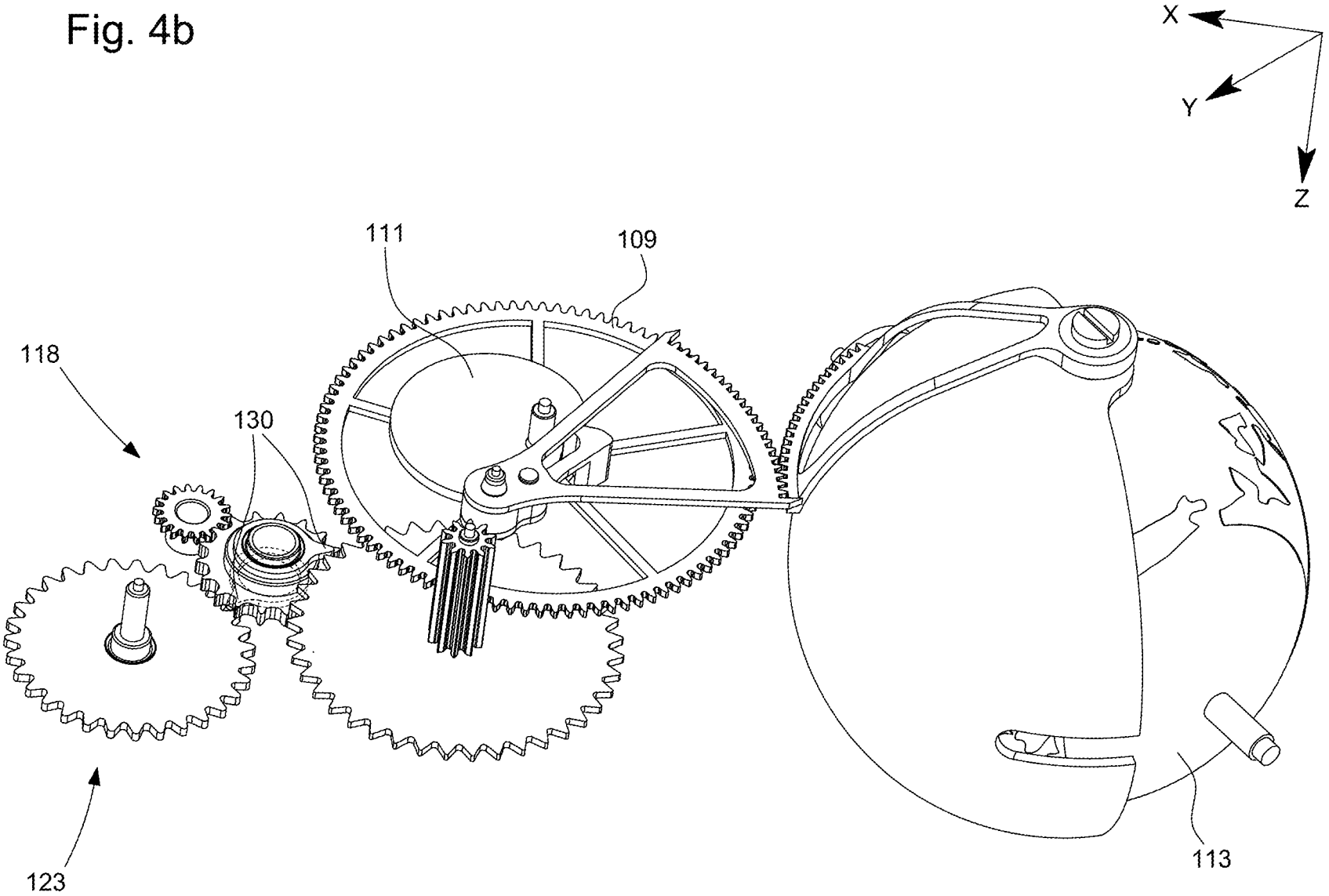

In the illustrated example, the hour wheel set is arranged to drive month display means 125 via a reduction gear train 118, which does not go through date display means 123. Reduction gear train 118 is composed as follows: hour wheel set 107 is integral in rotation with a reduction wheel set (not represented) which comprises an 18-tooth pinion. As shown in FIGS. 4*a* and 4*b*, the pinion of the reduction wheel set meshes with a 36-tooth wheel of a first intermediate wheel set (referenced 119) which is therefore arranged to complete one revolution in 24 hours. First intermediate wheel set 119 also comprises two fingers 130 which are arranged, once every 24 hours, to cooperate respectively with one of the teeth of a date star-wheel comprising 31 teeth, and with one of the teeth of a 40-tooth star-wheel, which forms part of a second intermediate wheel set (not represented), in order to advance each of the two star-wheels one step. The second intermediate wheel set also comprises a 10-tooth pinion arranged coaxially with the 40-tooth star-wheel. The 10-tooth pinion is arranged to mesh with a toothing of 93 teeth of an annual wheel set of month display means 125.

Still referring to FIG. 1, it is seen that the timepiece represented also comprises a tilt control mechanism (referenced 109) which comprises an annual cam 111 and a cam follower (not represented). According to the invention, hour wheel set 107 drives the annual cam via a third kinematic chain 118 which passes through month display means 125. In the illustrated example, annual cam 111 is borne by the annual wheel set of the month display means. The annual wheel set thus forms part of both tilt control mechanism 109 and month display means 125. It will thus be understood that, in the illustrated example, the third kinematic chain which, according to the invention, connects hour wheel set 107 and annual cam 111, is formed by reduction gear train 118 which was described above in relation to date display means 125. The ratio of reduction gear train 118 is 1:744. However, it is worth bearing in mind that, in the illustrated example, hour wheel set 107 is arranged to make one complete revolution every 12 hours (see FIG. 4*b*). Those skilled in the art will understand that, according to the invention, the hour wheel set could alternatively be arranged to rotate at the rate of one revolution every 24 hours (see FIG. 4*a*) instead of every 12 hours, and that, in such case, the ratio of the reduction gear train would be 1:372; the train would then be shortened.

According to the embodiment of the invention illustrated in FIG. 1, the movement of shell 113 relative to sphere 117 is the result of the combination of distinct rotations about two perpendicular axes that intersect at the centre of the sphere. The first of these two rotations is made by Earth, which is arranged to rotate at the rate of one revolution in 24 hours about the first of these two axes, and the other rotation corresponds to the pivoting of the dark half-spherical shell representing the dark 113 (dark half-sphere) about the second axis and manifests as a variation in the angle of tilt of the half-sphere with respect to the first axis. Since the movements of dark half-sphere 113 and of sphere 117 with respect to one another are two functionally independent movements, sunrise and/or sunset indicating mechanism 115 is represented twice in FIG. 1. Referring to the Figure, it will be understood that mechanism 115 is represented once to depict the rotation of sphere 117 at the rate of one revolution in 24 hours about the first axis, and a second time to depict the pivoting of dark half-sphere 113 about the second axis.

According to the invention, the pivoting motion about the second axis is controlled using annual cam 111, whose profile is representative of the relative tilt of the sun above or below the equatorial plane of the earth. The cam follower (not represented) is arranged to transmit the variations in the cam profile to half-spherical shell 113 through a first kinematic connection 112. According to the first embodiment of the invention, dark half-sphere 113 is mounted to pivot on a fixed support and the arrangement of indicator mechanism 115, like that of first kinematic connection 112, may conform, for example, to the description given in European Patent document EP 2911013. This document is incorporated by reference in the present description.

Referring again to FIG. 1, it can be seen that the timepiece whose operation is represented also comprises a certain number of corrector mechanisms which are arranged to be manually actuated by the wearer of the timepiece. First of all, as already mentioned, a time zone correction mechanism (referenced 101) is inserted between motion work 106 and hour wheel set 107. As will now be explained, mechanism 101 can be controlled in two different ways depending upon whether the change of hour relates to an actual change of longitude, following a journey for example, or relates to the change from winter time to summer time, or vice versa. In the illustrated example, when the wearer of the timepiece changes time zone during a trip, he can correct the time indication by means of control stem 131 of the timepiece. In order to do this, he must move stem 131 into position T2 before rotating the crown to move the hour hand forwards or backwards in a series of one-hour jumps. As was seen above, hour wheel set 107 drives month display mechanism 125 and annual cam 111 via third kinematic chain 118. Further, hour wheel set 107 also drives date mechanism 123 and Earth 117 in its rotation about the first axis. It will thus be understood that annual cam 111, calendar mechanism 123, 125 and sunrise and/or sunset indicating mechanism 115, are arranged to advance synchronously, not only when they are driven by drive mechanism 103, but also when they are manually driven forwards or backwards by means of control stem 131 in position T2.

Figure 5:
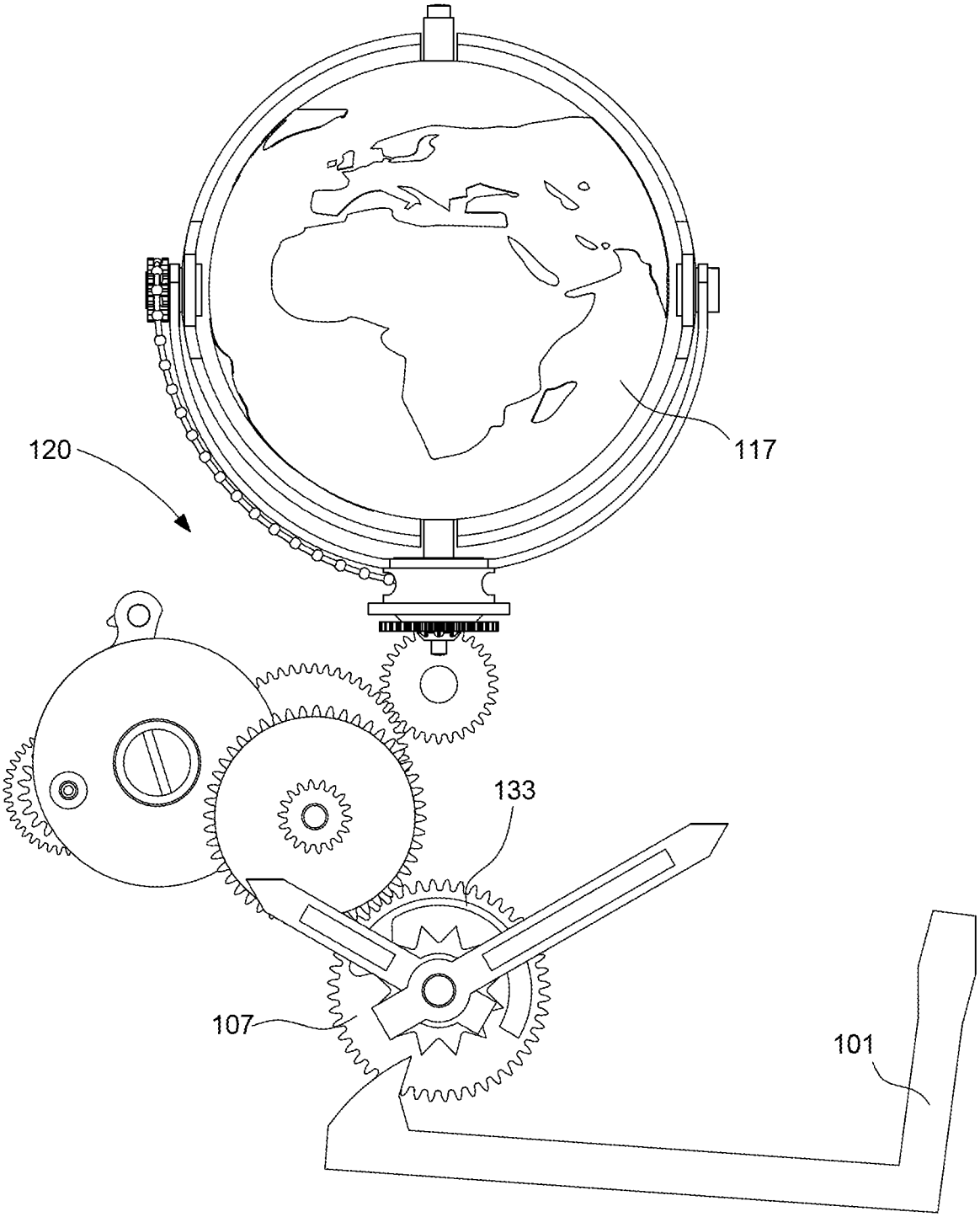
FIG. 5 is another view of structural elements of the timepiece.

In the illustrated example, at the change from winter time to summer time or from summer time to winter time, the wearer of the timepiece can move the time indication exactly one hour forward or back by actuating pusher P2. When it is actuated, pusher P2 acts not only on time zone correction mechanism 101, but also on a disengagement mechanism 133, so as to disengage second kinematic chain 120 (see also FIG. 5), which is arranged to drive Earth in rotation at the rate of one revolution in 24 hours. It will be understood that disengaging the second kinematic chain prevents the relative angular position of dark half-sphere 113 with respect to sphere 117 being affected by transitions between summer time and winter time.

In addition to the aforementioned time zone correction mechanism 101, the timepiece of the present example comprises a conventional type of time-setting mechanism. This time-setting mechanism allows the wearer of the timepiece to set the time with the aid of control stem 131 of the timepiece. In order to do this, he must move stem 131 into position T3 before rotating the crown. As in most current timepieces, the time-setting mechanism is arranged to drive motion work 106, which in turn drives minute wheel set 105 and hour wheel set 107. As was the case previously with correction of the time zone, hour wheel set 107 drives month display mechanism 125 and annual cam 111 via third kinematic chain 118. Further, hour wheel set 107 also drives date mechanism 123 and Earth in its rotation about the first axis. It will thus be understood that annual cam 111, calendar mechanism 123, 125 and sunrise and/or sunset indicating mechanism 115, are arranged to advance synchronously, also when they are driven manually forwards or backwards by means of control stem 131 in position T3.

Finally, the calendar mechanism of the timepiece of the present embodiment also comprises a month corrector mechanism. When the wearer of the timepiece wishes to correct the month indication, for example following an indeterminate period of stoppage of the timepiece, he can move the month indication step-by-step forwards or backwards by actuating pusher P1. As in the present example, the annual wheel set of month display means 125 also carries annual cam 111, this latter advances synchronously with the date indication, event when the date indication is changed with the aid of the date corrector.

Figure 2:
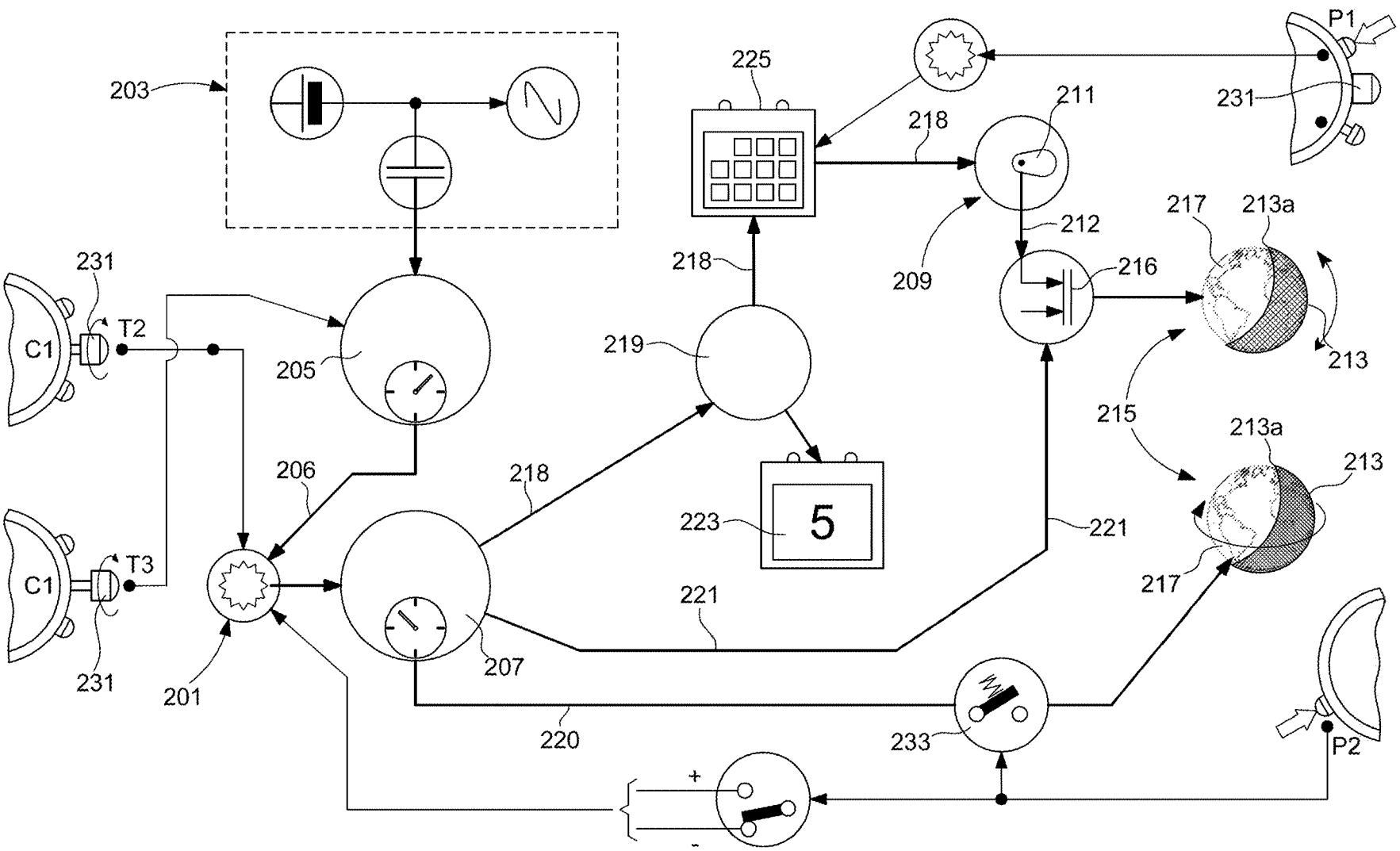
FIG. 2 is a block diagram briefly illustrating the kinematic connections between different mechanisms of a timepiece according to a second particular embodiment of the invention.

FIG. 2 annexed is a very similar block diagram to that of FIG. 1, but illustrating the kinematic connections associating different mechanism of a timepiece according to a second exemplary embodiment of the invention. As will be seen, the second embodiment is very similar to the first and, in particular, the correction mechanisms arranged to be actuated by the wearer of the timepiece are identical to those which were described in relation to the first embodiment. FIG. 2 represents a drive mechanism 203 that combines a drive member, a regulating member and an escapement, a minute wheel set (referenced 205) which is integral with a minute display member and which is arranged to be driven at the rate of one revolution per hour by the drive mechanism, an hour wheel set 207 integral in rotation with an hour display member, a motion work 206 connecting the minute wheel set to the hour wheel set such that the latter is driven at a rate of one revolution every 12 hours, a time zone correction mechanism (referenced 201) inserted between motion work 206 and hour wheel set 207, a tilt control mechanism (referenced 209) which comprises an annual cam 211, and a cam follower (not represented), and finally a sunrise and/or sunset indicating mechanism (referenced 215) comprising a sphere 217 that replicates the terrestrial globe and a half-spherical shell 213, which is arranged concentrically to the sphere.

In the illustrated example, hour wheel set 207 drives the annual cam via a third kinematic chain 218, which could be identical to kinematic chain 118 described above in relation to the first exemplary embodiment.

In the second embodiment, as in the first, the relative movement of half-sphere 213 and sphere 217 is the result of the combination of distinct rotations about two perpendicular axes that intersect at the centre of the sphere. However, according to the second embodiment, it is dark half-sphere 213 which simultaneously makes the two rotations, since sphere 217 is not driven. This operating mode is made possible by the fact that the support (not represented), on which dark half-sphere 213 is mounted, is a rotating support. Still referring to FIG. 2, it is clear that in the illustrated embodiment, hour wheel set 207 is connected to the rotating support (not represented) by a kinematic chain 220 (hereinafter the "second kinematic chain 220") which is provided with a disengagement mechanism 233 which could be quite similar to disengagement mechanism 133 described above in relation to the change from summer time to winter time. With the exception of disengagement mechanism 233, the arrangement of indicator mechanism 215 and that of second kinematic connection 220 could, for example, conform to the description in one or other of European Patent documents EP2977832 and EP3007012. These two documents are incorporated by reference in the present description.

Referring again to FIG. 2, it can be seen that a reference mechanism 216 is inserted between tilt control mechanism 209 and indicator mechanism 215. It can be seen that mechanism 216 comprises an output connected to indicator mechanism 215, and two inputs. A kinematic connection 221 (called the 'fourth kinematic connection' 221) connects hour wheel set 207 to the first of the two inputs. Mechanism 216 is thus driven by the hour wheel set through its first input, called the 'driving input'. It can also be seen that the cam follower (not represented) is connected to the second input by a kinematic connection 212 (called the 'first kinematic connection' 212) arranged to transmit the variations in the cam profile. Mechanism 216 is thus controlled by the profile of cam 211 through its second input, called the 'control input'. Just like second kinematic connection 220, the output of mechanism 216 is arranged to drive indicator mechanism 215 at a speed of one revolution in 24 hours. However, mechanism 216 drives the indicator mechanism with a certain offset with respect to second kinematic connection 220. Mechanism 216 can be realized in many ways without departing from the scope of the present invention. It may, for example, be a differential mechanism, especially a differential mechanism as described in European Patent No EP 2977832. It may also be a disengagement mechanism, especially a disengagement mechanism as described in European Patent No EP3007012.

Still referring to FIG. 2, it can be seen that the illustrated timepiece also comprises a calendar mechanism formed by the combination of a display mechanism for displaying the date 223 and a display mechanism for displaying the month 225. This calendar mechanism is of the 'simple calendar' type.

Figure 3A:
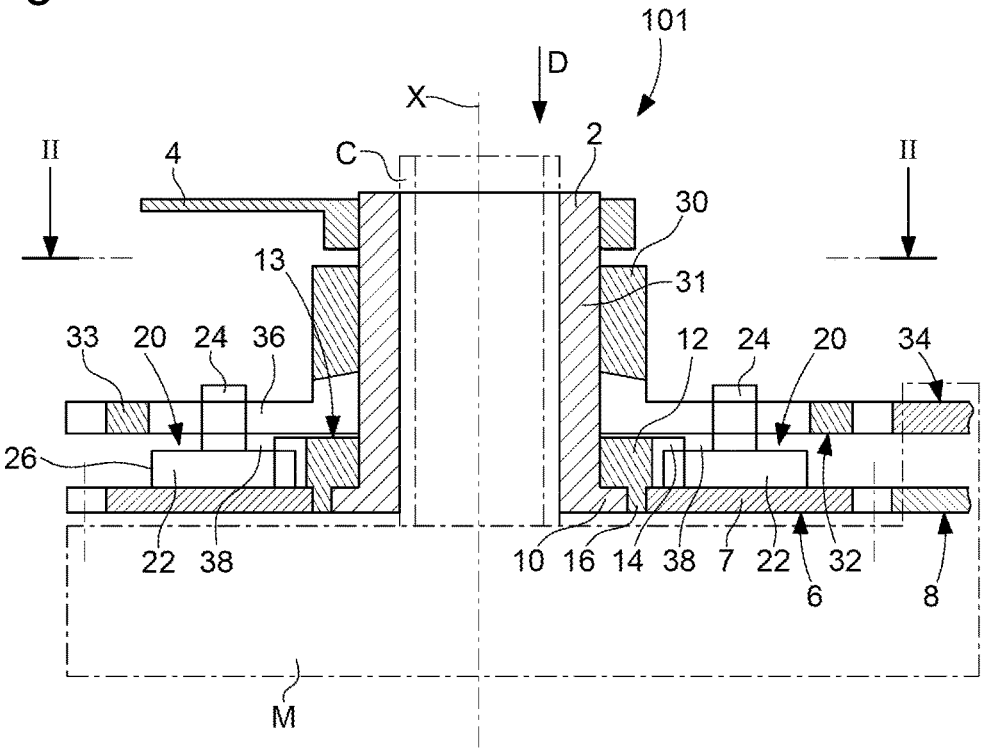
FIGS. 3A and 3B are respectively a cross-sectional view and a view of an example mechanism, known as such, which comprises a first and a second hour wheel and a disengageable coupling device arranged to make integral in rotation and index, or alternatively to disengage, the two hour wheels.
Figure 3B:
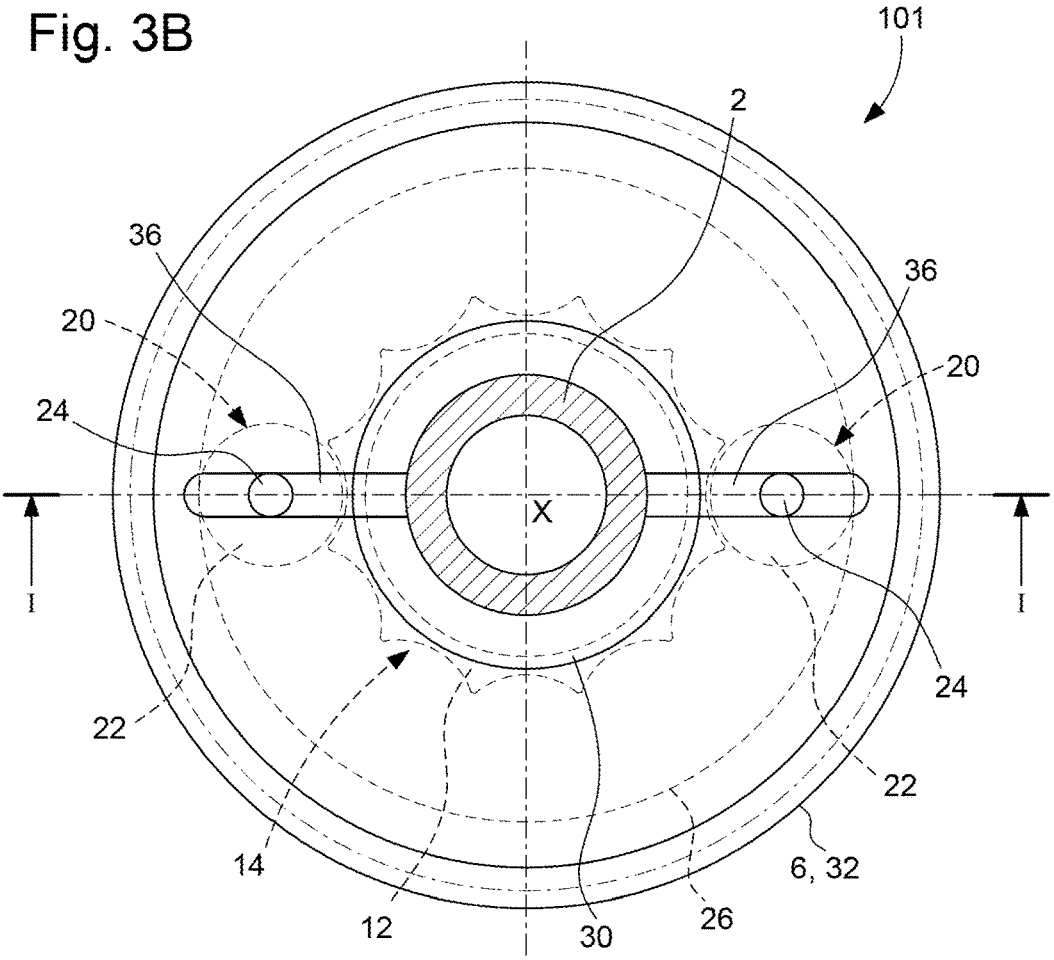

Referring now to FIGS. 3A and 3B, the summer/winter correction mechanism, which is generally designated by the reference 101, will now be described in more detail. It will be recalled that mechanism 101 was already represented in FIG. 1, inserted between motion work 106 and hour wheel set 107. Moreover, mechanism 201 represented in FIG. 2 could be identical to mechanism 101. Mechanism 101 comprises a first pipe? 2, called the inner pipe, intended to be mounted in rotation in a conventional manner, about an axis of rotation X, on a cannon-pinion C driven by drive mechanism 103 (shown in FIG. 1). Inner pipe 2 bears an indicator hand 4 forming the hour hand, which is externally pressed onto a free end of pipe 2 projecting from mechanism 101.

Inner pipe 2 thus forms an hour pipe, and it carries a first externally toothed wheel 6, called the lower wheel, comprising a plate 7. It will be specified here that, advantageously, this lower wheel 6 forms an hour wheel, and more specifically a 'motion-work hour wheel', and it meshes with a wheel 8 (partially represented) of motion work 106. In normal operation, this hour wheel 6 receives time information delivered by wheel 8 of the motion work, which information it transmits, as will be seen below, indirectly to inner hour pipe 2 and to indicator hand 4. Indeed, lower hour wheel 6 is mounted for free rotation on hour pipe 2. For this purpose, the end of hour pipe 2, opposite to the free end thereof carrying hand 4, comprises a collar 10 forming a shoulder freely supporting a star-wheel 12 on which wheel 6 is fixedly held. Star-wheel 12 comprises a plate 13, an external toothing 14 and a circular flange 16 arranged edgewise adjacent to toothing 14, behind and coaxially with the latter, underneath plate 13.

Hour wheel 6 is fixedly held on the side of star-wheel 12 against its toothing 14. Indeed, hour wheel 6 is force fitted externally onto flange 16, pressed and/or riveted thereon, via the central part of its plate 7 which has a bore opening. Star-wheel 12 and hour wheel 6 are thus directly integral in rotation and, in this example, as a result of their assembly, form a single piece placed on hour pipe 2. Star-wheel 12 and hour wheel 6 can thus be moved together concomitantly via wheel 8 of the motion work.

The summer/winter correction mechanism also comprises two drive rollers 20 which are stepped and which each have a cylindrical base 22 from which a stud 24 extends in a perpendicular manner. The rollers are both engaged at rest, via their base 22, in toothing 14 of star-wheel 12 and they rest freely and sideways via this base against the side (unreferenced) of plate 7 of hour wheel 6. This rest position is also represented in a top view in FIG. 3B. Rollers 20 are also resiliently held in this rest position in toothing 14, by elastic return means 26, which are formed here by a closed annular spring, mounted coaxially to star-wheel 12 and acting radially on the outer periphery of bases 22 of rollers 20. It will be noted here that spring 26 is freely mounted against drive rollers 20, without any fixed attachment to mechanism 101. Spring 26 also rests freely against, and more particularly on, plate 7 of hour wheel 6. Spring 26 is thus self-supported and self-centering.

The summer/winter correction mechanism further comprises a second pipe 30, called the outer pipe, which comprises a guide bore 31 and which is fixed externally via this bore 31 onto first pipe 2. This second pipe 30 carries a second externally toothed wheel 32 arranged above lower hour wheel 6 and called the 'upper wheel', and more specifically the 'hour-wheel'. It will be specified here that the upper and lower positions of wheels 6 and 32 refer to the drawing of FIG. 3A, which represents the correction mechanism with the hour hands oriented upwards. Upper wheel 32 comprises a plate 33 and it meshes via its outer toothing with a wheel 34, driven in turn by a corrector member, which is manually actuatable from outside the timepiece.

Upper wheel 34 thus forms a summer/winter correction wheel which, as will become clear, can directly correct the position of hour pipe 2 and of indicator hand 4, without acting on the motion work, and therefore without disrupting the other time information, such as the minutes and seconds, which are normally kinematically connected to hour pipe 2 via said motion work. Advantageously, outer pipe 30 is force fitted externally onto inner hour pipe 2 and it is thus secured thereto. These two pipes are therefore integral in rotation and they can be moved together. It will be understood that hour pipe 2, outer pipe 30 and upper wheel 34 together form hour wheel set 107. Upper correction wheel 34 can thus act on inner hour pipe 2 via outer pipe 30.

It will be specified that hour pipe 2 is also driven in normal operation by motion work 106, and in particular by wheel 8 of the motion work. This is why there are radial grooves 36 arranged in plate 33 of correction wheel 32, in which are freely engaged studs 24, which can translate radially in said grooves. Rollers 20 can thus drive in rotation correction wheel 32, and the two pipes 2 and 30, when star-wheel 12 is itself driven by hour wheel 6.

In order to change to another time zone, the user of the timepiece must rotate correction wheel 34; rollers 20 are then angularly displaced and jump (while star-wheel 12 and hour wheel 6 remain stationary) in toothing 14 of star-wheel 12, making spring 26 oval. Rollers 20 then return to the rest position in toothing 14 of star-wheel 12, but are offset with respect to the position of FIG. 2. Hand 4 then indicates another time zone. It will be specified that, although the toothing of star-wheel 12 has 12 teeth in the Figures (to indicate the 12 hours), this toothing could have 24 teeth for application to a 24-hour timepiece.

It will also be clear that various alterations and/or improvements evident to those skilled in the art may be made to the embodiment forming the subject of the present description without departing from the scope of the present invention defined by the annexed claims.

What is claimed is:

1. A timepiece comprising:

a timepiece movement;

a calendar mechanism; and means for indicating the sunrise and sunset that take account of seasonal variations, the timepiece movement comprising a minute wheel set, a motion-work, an hour indicator member, and an hour wheel set integral in rotation with the hour indicator member and arranged to be driven by the minute wheel set via the motion-work either at a speed of one revolution in 12 hours, or at a speed of one revolution in 24 hours, the calendar mechanism being arranged to be driven via the hour wheel set and comprising a date display and a month display, the sunrise and sunset indicating means comprising a sphere that replicates the terrestrial globe and a ring mounted concentrically to the sphere and arranged to indicate the position of the earth's terminator, the sphere being arranged to be driven in order to rotate, at a rate of one revolution in 24 hours, about a first axis corresponding to the polar axis of the terrestrial globe, and the ring being mounted in order also to be able to pivot relative to the sphere about a second axis intersecting the first axis perpendicularly at the centre of the sphere, the sunset and sunrise indicating means further comprising an annual cam having a profile representative of the tilt of the sun with respect to the equatorial plane, and arranged to be driven in rotation at a rate of one revolution per year, the plane subtended by the ring forming with the first axis an angle equal to the angle of tilt of the sun with respect to the equatorial plane;

wherein all months of the calendar mechanism include 31 days such that the calendar mechanism is a simple calendar mechanism, wherein the timepiece movement comprises a third kinematic chain connecting the annual cam to the hour wheel set via the display mechanism for displaying the month, wherein, either the third kinematic chain has a transmission ratio of 1:744 in the case where the hour wheel set is arranged to be driven by the motion work at a speed of one revolution in 12 hours, or the third kinematic chain has a transmission ratio of 1:372 in the case where the hour wheel set is arranged to be driven by the motion work at a speed of one revolution in 24 hours, and wherein the third kinematic chain comprises a reduction gear train with a ratio of 1:744 and comprising a reduction wheel set which comprises an 18-tooth pinion and which is integral in rotation with the hour wheel set, the pinion of the reduction wheel set meshing with a 36-tooth wheel of a first intermediate wheel set arranged to complete one revolution in 24 hours, the first intermediate wheel set being provided with two fingers arranged respectively to advance step-by-step, once in 24 hours, a date star-wheel comprising 31 teeth, and a 40-tooth star-wheel of a second intermediate wheel set, the second intermediate wheel set further comprising a 10-tooth pinion coaxially integral with the 40-tooth star-wheel, the 10-tooth pinion being arranged to mesh with a toothing of 93 teeth of an annual wheel set on which the annual cam is mounted.

2. The timepiece according to claim 1, wherein the timepiece has a second kinematic chain connecting the hour wheel set to the sphere in order to drive the sphere at a rate of one revolution in 24 hours, and wherein the timepiece movement comprises a manually actuatable time zone correction mechanism arranged to pivot the hour wheel set step-by-step independently of the motion work, and a disengagement mechanism arranged to disengage the second kinematic chain when the time zone correction mechanism pivots the hour wheel set to change from summer time to winter time, or vice versa.

3. The timepiece according to claim 2, wherein the timepiece movement comprises a first hour wheel meshing with the motion work and a second hour wheel, which is integral with said hour wheel set, and wherein the time zone correction mechanism comprises a disengageable coupling device arranged to make the first and second hour wheels integral in rotation in one or other of a plurality of predefined relative angular positions, said angular positions being equidistant and spaced apart from each other by an angle corresponding to the distance travelled in one hour by the hour indicator member.

4. The timepiece according to claim 1, wherein the timepiece movement comprises a manually actuatable time-setting device arranged to act on the minute wheel set and the motion work, such that the hour wheel set, the hour indicator member, the date display, the month display, the annual cam and the angular position of the sphere are also affected.

5. The timepiece according to claim 1, wherein the sunrise and sunset indicating means that takes account of seasonal variations comprises a shell arranged concentrically to the sphere replicating the terrestrial globe, the shell being arranged to demarcate one part of the terrestrial globe where it is night time from another part where it is daytime, and wherein the shell has the general shape of a half-sphere and has a rim of generally circular shape, the rim forming the ring arranged to indicate the position of the earth's terminator.

6. The timepiece according to claim 5, wherein the second axis is substantially collinear with a diameter of the ring.

7. The timepiece according to claim 6, wherein the rim forming the ring has two notches arranged in diametrically opposite positions midway between two pivots.

8. The timepiece according to claim 1, wherein the timepiece is a watch.

9. A timepiece comprising:

a timepiece movement;

a calendar mechanism; and means for indicating the sunrise and sunset that take account of seasonal variations, the timepiece movement comprising a minute wheel set, a motion work, an hour indicator member, and an hour wheel set integral in rotation with the hour indicator member and arranged to be driven by the minute wheel set via the motion-work either at a speed of one revolution in 12 hours, or at a speed of one revolution in 24 hours, the calendar mechanism being arranged to be driven via the hour wheel set and comprising a date display and a month display, the sunrise and sunset indicating means comprising a sphere that replicates the terrestrial globe and a ring mounted concentrically to the sphere and arranged to indicate the position of the earth's terminator, the ring being arranged to be driven in order to rotate, at a rate of one revolution in 24 hours, about a first axis corresponding to the polar axis of the terrestrial globe, and the ring being also mounted in order also to be able to pivot relative to the sphere about a second axis intersecting the first axis perpendicularly at the centre of the sphere, the sunset and sunrise indicating means further comprising an annual cam having a profile representative of the tilt of the sun with respect to the equatorial plane, and arranged to be driven in rotation at a rate of one revolution per year, the plane subtended by the ring forming with the first axis an angle equal to the angle of tilt of the sun with respect to the equatorial plane, wherein all months of the calendar mechanism include 31 days such that the calendar mechanism is a simple calendar mechanism, wherein that the timepiece movement comprises a third kinematic chain connecting the annual cam to the hour wheel set via the month display, wherein, either the third kinematic chain has a transmission ratio of 1:744 in the case where the hour wheel set is arranged to be driven by the motion work at a speed of one revolution in 12 hours, or the third kinematic chain has a transmission ratio of 1:372 in the case where the hour wheel set is arranged to be driven by the motion work at a speed of one revolution in 24 hours, and wherein the third kinematic chain comprises a reduction gear train with a ratio of 1:744 and comprising a reduction wheel set which comprises an 18-tooth pinion and which is integral in rotation with the hour wheel set, the pinion of the reduction wheel set meshing with a 36-tooth wheel of a first intermediate wheel set arranged to complete one revolution in 24 hours, the first intermediate wheel set being provided with two fingers respectively arranged to advance step-by-step, once in 24 hours, a date star-wheel comprising 31 teeth, and a 40-tooth star-wheel of a second intermediate wheel set, the second intermediate wheel set further comprising a 10-tooth pinion coaxially integral with the 40-tooth star-wheel, the 10-tooth pinion being arranged to mesh with a toothing of 93 teeth of an annual cam wheel set on which the annual cam is mounted.

10. The timepiece according to claim 9, wherein the timepiece has a second kinematic chain connecting the hour wheel set to the ring in order to drive the ring at a rate of one revolution in 24 hours, and wherein the timepiece movement comprises a manually actuatable time zone correction mechanism arranged to pivot the hour wheel set step-by-step independently of the motion work, and en the other hand, a disengagement mechanism arranged to disengage the second kinematic chain when the time zone correction mechanism pivots the hour wheel set to change from summer time to winter time, or vice versa.

11. The timepiece according to claim 10, wherein the timepiece movement comprises a first hour wheel meshing with the motion work and a second hour wheel, which is integral with said hour wheel set, and wherein the time zone correction mechanism comprises a disengageable coupling device arranged to make the first and second hour wheels integral in rotation in one or other of a plurality of predefined relative angular positions, said angular positions being equidistant and spaced apart from each other by an angle corresponding to the distance travelled in one hour by the hour indicator member.

12. The timepiece according to claim 9, wherein the timepiece movement comprises a manually actuatable time-setting device arranged to act on the minute wheel set and the motion work, such that the hour wheel set, the hour indicator member, the date display, the month display, the annual cam and the angular position of the ring about the first axis are also affected.

13. The timepiece according to claim 9, wherein the sunrise and sunset indicating means that takes account of seasonal variations comprises a shell arranged concentrically to the sphere replicating the terrestrial globe, the shell being arranged to demarcate one part of the terrestrial globe where it is night time from another part where it is daytime, and wherein the shell has the general shape of a half-sphere and has a rim of generally circular shape, the rim forming the ring arranged to indicate the position of the earth's terminator.

14. The timepiece according to claim 13, wherein the second axis is substantially collinear with a diameter of the ring.

15. The timepiece according to claim 14, wherein the rim forming the ring has two notches arranged in diametrically opposite positions midway between two pivots.

* * * * *